US005115581A

United States Patent [19]

Viitanen

[11] Patent Number: 5,115,581

[45] Date of Patent: May 26, 1992

[54] SUCTION BEAM

[75] Inventor: Olavi Viitanen, Jyväskylä, Finland

[73] Assignee: Valmet Paper Machinery Inc., Finland

[21] Appl. No.: 668,082

[22] Filed: Mar. 12, 1991

[30] Foreign Application Priority Data

Mar. 16, 1990 [FI] Finland ..... 901339

[51] Int. Cl.[5] ..... F26B 13/30

[52] U.S. Cl. ..... 34/115; 34/117

[58] Field of Search ..... 34/23, 114, 115, 117, 34/120, 123

[56] References Cited

U.S. PATENT DOCUMENTS 4,516,330 5/1985 Eskelinen et al. ..... 34/117 X 4,628,618 12/1986 Virta et al. ..... 34/116

*Primary Examiner*—Henry A. Bennet

*Attorney, Agent, or Firm*—Steinberg & Raskin

[57] ABSTRACT

A beam construction used in the area of single-draw of the drying wire (13) in a paper machine or the equivalent thereof is placed in proximity of the straight joint run of the drying wire (13) and the web (W) between the drying cylinder (10) and the leading cylinder (12) or roll on a sector (a) of the leading cylinder (12) or roll that is otherwise free from the drying wire (13). The beam construction comprises a static closing-suction beam (20) with no blowing members. The closing-suction beam (20) covers the drying wire (13) which runs form the drying cylinder (10) onto the subsequent leading cylinder (12) or roll, the web (W) being placed on the opposite face of said wire (13). At the inlet edges of the closing-suction beam (20) transverse seals (27,28) are placed against the drying wire (13) and the leading cylinder (12) as well as lateral seals (25, 25*a*) at the ends of the closing-suction beam (20). These prevent the access of air into the spaces (14,15) between the closing-suction beam (20) and the drying wire (13) and the leading cylinder (12). Negative pressure is produced in the latter spaces (14,15) and in the inlet nip (N+) between the leading cylinder (12) and the drying wire (13) by the intermediate of perforations (12*c*) in the mantle (12*b*) of the leading cylinder (12) out of the negative pressure prevailing inside the mantle (12*b*) of the leading cylinder (12).

11 Claims, 2 Drawing Sheets

SUCTION BEAM

FIELD OF THE INVENTION

The invention is related to a beam construction used in the area of single-wire draw of the drying wire in a paper machine or equivalent. The beam construction is placed in proximity to the straight joint run of the drying wire and the web between the drying cylinder and the leading cylinder or roll on a sector of the leading cylinder or roll that is otherwise free from the drying wire.

BACKGROUND OF THE INVENTION

The present invention is related to the cylinder group or groups provided with single-wire draw in the drying section of a paper machine or a paper finishing machine. Single-wire draw is known in the art to means such a mode of drawing and supporting the web in which the drying wire runs in a meandering manner from one row of cylinders to the other such that on the heated cylinders, the web enters into direct contact with the cylinder face and, on the leading cylinders or rolls placed between the drying cylinders, the web is placed at the side of the outside curve.

As is well known, moving faces induce air flows which move therealong with, and in a drying section this results in the drawback that an area of positive pressure is formed in the inlet nip between the drying wire and the leading cylinder. This pressure tends to detach the web from the drying wire, causing a case bag to be formed in the web. It is a further drawback that, when the drying wire and the web depart from the drying cylinder, occassionally the web attempts to follow the face of the drying cylinder, in which case a break or a wrinkle may be formed in the web.

The problems discussed above have been eliminated efficiently by means of the applicant's "UNO-RUN-BLOW-BOX" and "UNO-VAC" ® rolls, which are used as leading rolls between heated drying cylinders. With respect to the applicant's "UNO-RUN-BLOW-BOXes" ®, reference is made to the applicant's FI Patents Nos. 65,460 and 69,332 (corresponding to U.S. Pat. Nos. 4,516,330 and 4,628,618, respectively). With respect to the "UNO-VAC"R rolls, reference is made to the applicant's FI Patents Nos. 881106, 893893 and 895928, of which the first one corresponds to U.S. Pat. Appl. 320,985. The above-mentioned U.S. Patents are hereby incorporated by reference.

Even though, in itself, by means of its suction effect, a "UNO-VAC" ® roll keeps the paper firmly in contact with the surrounding wire, it has, however, been found that at an inlet nip, the wedge of air arriving along with the wire and with the roll face produces a pressure impact through the wire onto the web, and in the web a convex bump bag is formed. Thus, the paper is detached from the wire at a distance of from about 50 to about 150 mm. This extra stretching is a detrimental phenomenon which may cause wrinkles or folds in the web. This detrimental phenomenon can be prevented by the use of these "BLOW BOXes" ®, which operate by means of air supplied by a blower and in which the air discharged out of a nozzle slot evacuates air out of the nip.

Occassionally however, the requirement of constant pumping capacity and the highly sophisticated construction have been experienced as drawbacks of the "BLOW-BOXes" ®. Also, in some cases, the locating of the air pipes passing into the blow boxes is not entirely easy, because of the limited space available.

SUMMARY OF THE INVENTION

An Object of the present invention is to provide new, alternative suction-beam constructions as well as solutions for the problems discussed above.

In view of achieving the objectives stated above and those mentioned hereinafter, the invention is related to a beam construction which comprises a static closing-suction beam without blowing members which covers the drying wire running from the drying cylinder onto the subsequent leading cylinder or roll, the web being placed on the opposite face of the wire, that at the inlet edges of the closing-suction beam there are transverse seals placed against the drying wire and the leading cylinder as well as lateral seals at the ends of the closing-suction beam. These seals prevent the access of air into the spaces between the closing-suction beam and the drying wire and the leading cylinder, Negative pressure is produced in these spaces and in the inlet nip between the leading cylinder and the drying wire by the intermittent perforations in the mantle of the leading cylinder out of the negative pressure prevailing inside the mantle of the leading cylinder.

The closing-suction beam in accordance with the present invention operates as a static filler piece, which closes the narrowing wedge space between the suction-leading cylinder and the drying wire coming from the drying cylinder, i.e. the inlet nip, from all sides.

The suction beam in accordance with the invention is a fully static, partly sealed box beam of low-weight construction with no external suction or blowing. The necessary suction is obtained from the leading cylinder placed at its proximity fully "free". The main part of the detrimental air wedge that attempts to enter into the nip is rejected by means of resilient transverse sealing ribs, which are in contact with the face of the leading cylinder and with the drying wire. The ends of the suction beam are also provided with sealing members. In this way a partly sealed space is formed, out of which the leading cylinder evacuates air and produces a sufficient negative pressure, from about 100 to about 200 Pa, within a limited area of effect. This prevents formation of a bag, supports the web between the cylinders against the drying wire, and reduces the tendency of the paper to be wound around the drying cylinders.

Thus, the invention provides a suction beam of simple construction and low weight requiring no pumping capacity and no maintenance.

BRIEF DESCRIPTION OF THE DRAWINGS

In the following explanation, the invention will be described in detail with reference to some preferred embodiments of the invention illustrated in the Figures in the drawing, the invention being by no means strictly confined to the details of these embodiments

DESCRIPTION OF THE PREFERRED EMBODIMENTS

Figure 1:
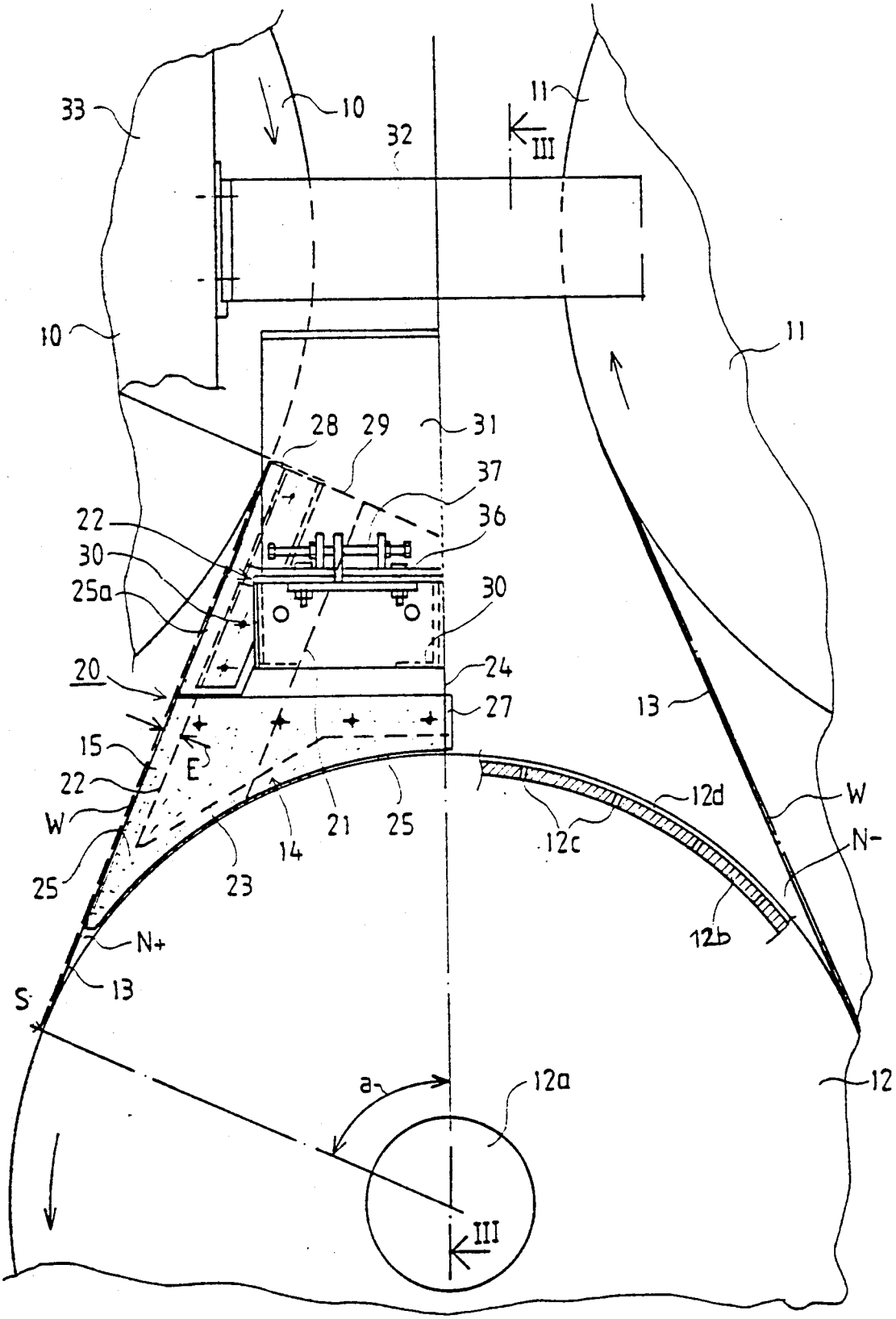
FIG. 1 is a schematic, partly sectional view in the machine direction of a suction beam in accordance with the invention as placed in its environment of operation.

In the drying section of the paper machine, in the Figures, only the steam-heated upper cylinders 10 and 11 and the leading cylinder or roll 12 are shown The drying section is provided with single-wire draw, which means that the web W runs from the upper cylinders 10 onto the lower cylinders 12 and, in a corresponding way, from the lower cylinders onto the following upper cylinders 11 while supported by the drying wire 13. The heated upper cylinders 10, 11 remain inside the loop of the drying wire 13 so that the drying wire 13 presses the web W to be dried into an efficient drying contact against the smooth faces of the cylinder 10, 11. The lower leading cylinders 12 are not heated, and in their area the web W remains on the outer face of the drying wire 13.

On the turning sectors of the lower cylinders 12, the web W is kept in tight contact with the outer face of the drying wire 13 by the effect of the negative pressure effective inside the leading cylinder 12. The negative pressure is sucked into the cylinders 12 by the intermediate of the duct **12*a*, and the suction effect spreads through intermittent holes or perforations 12*c* in the cylinder 12 mantle 12*b* into the outside grooves 12*d* passing around the cylinder mantle 12*b*, the holes 12*c* opening into said grooves 12*d*. By the intermediate of the grooves 12*d*, the negative pressure acts upon the web W through the permeable drying wire 13 and keeps the web securely on the drying wire 13 against the effect of centrifugal forces such that the web W does not form bags or wrinkles. The leading cylinders 12** are, for example, cylinders marketed by the applicant under the trade mark "UNO-VAC" ®.

According to the invention, static suction beams 20 are employed on the runs of the drying wire 13 between the drying cylinder 10, 11 and the leading cylinders 12 on which the web W runs from the drying cylinder 10 onto the leading cylinder 12, which is generally, but not necessarily, a lower cylinder. In such a case, as shown in FIG. 1, owing to the moving faces, a positive pressure of air tends to be induced in the inlet nip N+, because of which, as is known in prior art, at the point S, the web W had tended to be detached from the face of the drying wire 13 and to form a bag, which causes a wrinkle in the web. Earlier, in order to eliminate these drawbacks, the applicant has used so-called "UNO-RUN-BLOW-BOXex" on which to operate, in the way described above, as air-blow boxes, by whose means an area of negative pressure is ejected onto the run of the drying wire on which the above area of positive pressure tends to be formed in the inlet nip N+.

According to the present invention, the requirement for blowing energy has been obviated and the construction has been simplified by using particular static suction beams 20, which are placed on the sectors a of the leading cylinders 12 to close the inlet nip N+. In the invention, the suction of the static beam 20 is produced out of the leading cylinder 12 or an equivalent roll by the intermediate of the holes **12*c* in its mantle 12*b***, and no external source of suction, with spacious pipes passing into its interior, is required.

Figure 3:
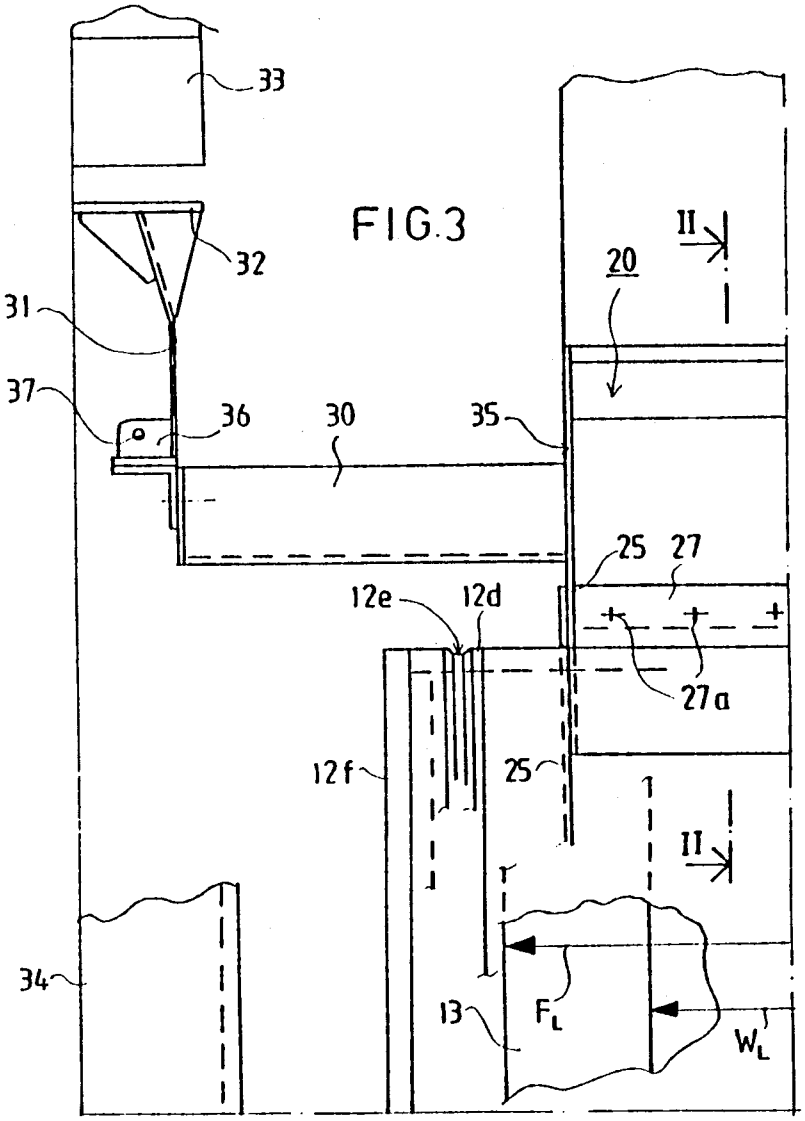
FIG. 3 is a vertical sectional view, taken along the line III—III shown in FIG. 1, of the end area of the suction beam in accordance with the invention and of the mounting of the suction beam in the frame construction of the drying section.
Figure 2:
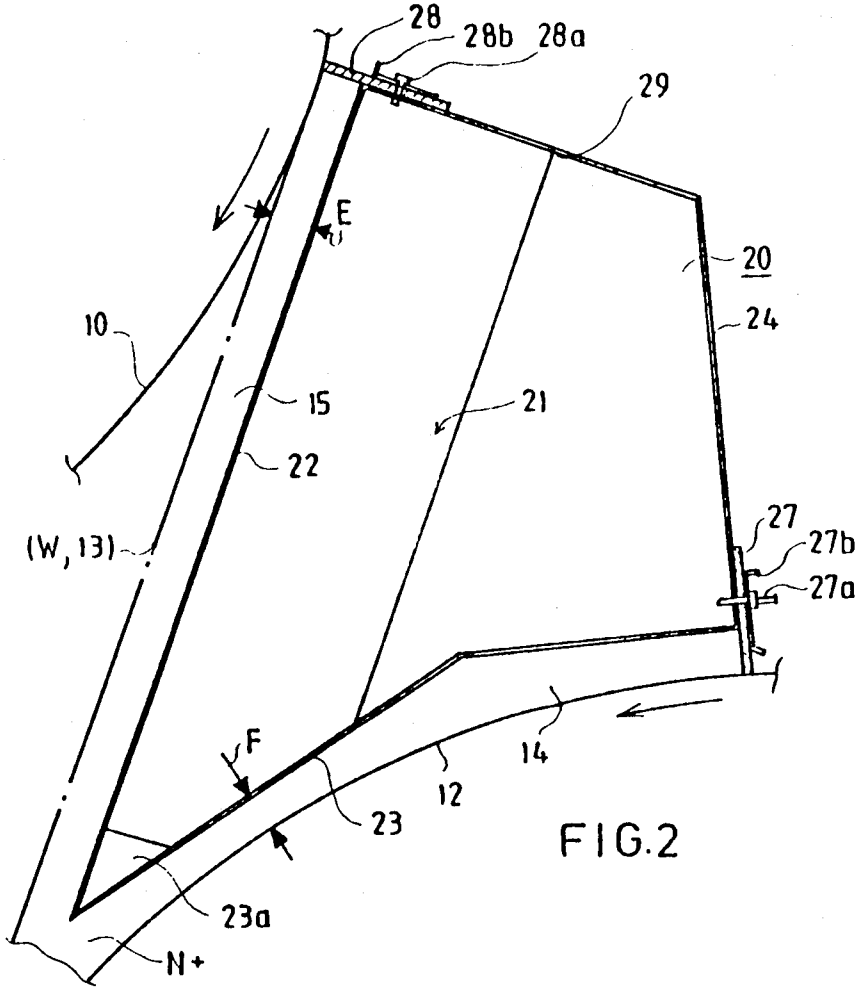
FIG. 2 is a vertical sectional view in the machine direction, in the plane II—II shown in FIG. 3, of a more detailed embodiment of the suction beam in accordance with the invention.

The suction beam 20 shown in the figure comprises a box beam construction, which is provided with a plane wall 22 placed at a short distance E facing the drying wire 13 running from the upper cylinder 10 onto the leading cylinder 12 or roll. On the sector a of the lower cylinder 12, the suction beam 20 is provided with a wall 23, and at the opposite side with outer walls 24 and 29. The beam 20 is provided with closed ends 35 as well as with plate parts 21 in the machine and vertical direction, with an appropriate transverse spacing to rigidify the beam construction, for example, with a spacing of about 5 m. The suction beam 20 is supported by means of both of its ends 35, at the driving side and at the operating side of the machine, by means of support beams 30, on the support parts 31, 32. In FIGS. 1 and 3, these support parts 30, 31, 32 at the operating sides as well as the frame beams 33, 34 at the operating side are shown. Further, FIG. 3 shows the end **12*f* of the leading cylinder 12, at whose proximity the cylinder 12 mantle 12*b* is provided with a groove 12*e* for the threading ropes. Between the support beams 30 and 31, there are adjusting means 36, by means of whose adjustment screws 37 the suction beam 20 can be placed exactly in the correct position so that the distance E from the drying wire 13 at the wall 22 as well as the distance F from the mantle of the leading cylinder 12** can be made suitable. The distance E and F are most appropriately from about 20 to about 40 mm, preferably, about 30 mm.

The suction beam 20 closes the inlet nip N+. This air closure is intensified by the transverse sealing ribs 27 and 28. The sealing rib 27 is placed in connection of the lower edge of the wall 24 of the beam 20, being attached to said wall by means of screws **27*a* and support plates 27*b* such that the lower face of the rib 27, which is made, e.g., of teflon, rubs against the outer face of the cylinder 12. In a corresponding way, the outer rib 28 is attached by means of screws 28*a* and a support place 28*b* in connection with the edge between the walls 22, 29 to rub against the drying wire 13 as the wire departs from the upper cylinder 10**.

In connection with the walls 22 and 23 of the suction beam 20, facing the cylinder 12, there is a little gap space 14, and facing the straight run of the drying wire 13 a little gap space 15. Into these spaces 14, 15, negative pressure is evacuated through the holes **12*c* and grooves 12*d* in the mantle 12*b* of the cylinder 12. By means of the seals 27 and 28, induction of air into the gap spaces 14 and 15 is prevented, whereby, both in these spaces 14, 15 and in the inlet nip N+, a slight negative pressure is produced, which is of an order of from about 100 to about 200 Pa, while there is a negative pressure of about 2000 Pa inside the mantle 12*b* of the cylinder 12. The negative pressure present in the space 15 behind the seal 28 has the effect that the web W follows reliably along with the drying wire 13 and does not follow the face of the cylinder 10. As is shown in FIG. 1, by means of the suction beam 20, its transverse seal ribs 27 and 28, and by means of the longitudinal seal ribs 25 and 25*a*, the zone of negative pressure are produced "free" by the effect of the negative pressure prevailing naturally inside the roll 12. The gap space 14 placed in connection with the lower cylinder 12 on the sector a is closed by sealing plates 25 placed in connection with both of the ends 35 of the suction beam 20. These plates 25 are placed at a certain little distance from the cylinder 12 face and from the wire 13. The gap space 15 is closed in the machine direction by the straight outer edge of this sealing plate 25 and by the ribs 25*a***.

FIG. 3 shows the area of the operating-side end **12*f* of the leading cylinder 12, in which area the arrow $F_L$ denotes the edge and the width of the drying wire 13 and the arrow $W_L$ denotes the edge and the width of the web W. As is seen from FIG. 3, the sealing plates 25 and the ends 35 of the suction beam 20 are placed inside the width $F_L$ of the drying wire 13** but outside the width $W_L$ of the web W.

The wall 23 placed on the sector a of the cylinder 12 is provided with a hole 23*a* or with a series of holes, by whose means it is achieved that inside the suction beam 20, there prevails the same level of negative pressure as outside the walls 22 and 23 of the beam 20 in the gap spaces 14, 15. In such a case, the difference in pressure do not produce undue forces or deflections on the beam 20 and on its walls.

According to the invention, as the static suction beam 20, it is possible to use a beam of relatively low-weight construction, because only small pressure loads are applied to it, and the suction beam 20 can be constructed such that its weight is only from about 50 to about 70 kg per meter of length.

Closing-suction beams in accordance with the invention are employed in the cylinder groups provided with single-wire draw in paper machines or paper finishing machines in all inlet nips of their leading cylinders or rolls or only in the inlet nips in which the problems discussed above occur. A particularly advantageous mode of application of the invention is to use the closing-suction beams 20 in connection with substantially all of these inlet nips such that the upper cylinders are drying cylinders heated by steam or equivalent, the web being in direct contact with the faces of such cylinders, and the lower cylinders or rolls are leading cylinders or rolls whose mantle is provided with perforations and preferably also with outside grooves passing around the mantle.

The invention is suitable for use in connection with all leading cylinders on whose free mantle a suction effect is present which can be applied in accordance with the invention to the gap spaces placed in connection with the static closing-suction beam to produce a field of negative pressure, by whose means the mutual support contact between the drying wire 13 and the web W is improved and effects of air flows and fields of positive pressure induced by moving faces are prevented.

While there has been described various details of the present invention, those skilled in the art will appreciate that various modifications, changes, additions and omissions in the construction illustrated and described can be made without departing from the spirit of the invention, and such are considered to be within the scope of the appended claims.

I claim:

1. A drying section of a paper machine for drying a web, comprising a drying cylinder, a roll adjacent to said drying cylinder, said roll comprising a mantle having intermittent perforations leading to an interior portion of said mantle having negative pressure, an inlet nip disposed between said roll and said drying cylinder, a drying wire having a straight run between said drying cylinder and said roll for forming a joint run with the web in a direction from said driving cylinder to said roll, said drying wire having a first face contacting said roll and an opposite face contacting the web, said roll having a sector which is not contacted by said drying wire, a static closing-suction beam with no blower members, said beam disposed in proximity to said straight joint run of said drying wire and the web between said drying cylinder and said roll and in proximity to said sector of said roll, such that a space is present between said beam, said drying wire and said roll, said beam covering said drying wire, and a plurality of seals preventing the access of air into said space such that negative pressure is produced in said space and in said inlet nip via said intermittent perforations, the web being kept in tight contact with said opposite face of said drying wire in said straight joint run against the effect of centrifugal forces by said negative pressure.

2. The drying section of claim 1, wherein said seals comprise transverse seals placed against said drying wire and said roll, and lateral sealing ribs operating against an outer face of said mantle, said straight joint run, or both.

3. The drying section of claim 2, wherein said beam further comprises a first and second wall which approach each other in a wedge shape, and two outer walls having edges provided with said transverse seals.

4. The drying section of claim 2, wherein said beam further comprises vertical partition walls in a machine direction, said vertical partition walls being transversely spaced to rigidify said beam.

5. The drying section of claim 4, further comprising operating-side and driving-side frame members, said beam having support members and two closed ends, said beam being attached to said operating-side members and driving-side frame members by said ends and said support members.

6. The drying section of claim 5, wherein said lateral seal ribs are placed in connection with said closed ends of said beam, and wherein said drying wire and the web have outer edges and there is an area between said outer edges of said drying wire and the webs, said lateral seal ribs being disposed in a transverse direction in said area.

7. The drying section of claim 5, further comprising adjusting and setting means connected to said support members, said adjusting and setting means adapted to allow said beam to be set and adjusted to a desired position in conjunction with said inlet nip to close said inlet nip.

8. The drying section of claim 3, wherein said beam further comprises a plane wall located in proximity to said drying wire, and wherein said first wall is disposed in proximity to an outer face of said mantle in said sector of said roll.

9. The drying section of claim 1, wherein said drying cylinder is heated by steam or an equivalent thereof, said drying cylinder having a face contacting the web, and said mantle includes outside grooves, said perforations opening into said grooves.

10. The drying section of claim 9, wherein said drying cylinder is an upper cylinder located above said roll and said roll is a lower cylinder.

11. The drying section of claim 8, wherein the distance between said plane wall and said drying wire and the distance from said first wall to said outer face are both from about 20 to about 40 mm.

* * * * *